US011794797B2

(12) United States Patent
Fox et al.

(10) Patent No.: US 11,794,797 B2
(45) Date of Patent: Oct. 24, 2023

(54) REMOTE CONTROL OF TRAFFIC GATES

(71) Applicant: Railway Equipment Company, Inc., Minneapolis, MN (US)

(72) Inventors: David Fox, Boca Grande, FL (US); Randall Gene Honeck, Maple Grove, MN (US); Jason Lee Honeck, Maple Grove, MN (US)

(73) Assignee: Railway Equipment Company, Inc., Minneapolis, MN (US)

( * ) Notice: Subject to any disclaimer, the term of this patent is extended or adjusted under 35 U.S.C. 154(b) by 536 days.

(21) Appl. No.: 16/997,997

(22) Filed: Aug. 20, 2020

(65) Prior Publication Data

US 2021/0053597 A1 Feb. 25, 2021

Related U.S. Application Data

(60) Provisional application No. 62/890,398, filed on Aug. 22, 2019.

(51) Int. Cl.

| | |
|---|---|
| ***B61L 29/04*** | (2006.01) |
| ***B61L 29/30*** | (2006.01) |
| ***B61L 29/22*** | (2006.01) |
| *E01F 13/06* | (2006.01) |

(52) U.S. Cl.

CPC ..... *B61L 29/04* (2013.01); *B61L 29/228* (2013.01); *B61L 29/30* (2013.01); *E01F 13/06* (2013.01)

(58) Field of Classification Search

CPC ..... B61L 29/04; B61L 29/228; B61L 29/30; E01F 13/06

See application file for complete search history.

(56) References Cited

U.S. PATENT DOCUMENTS

2019/0254136 A1* 8/2019 Brinkman ..... G06F 3/0202

OTHER PUBLICATIONS

"Canadian Application Serial No. 3,090,607, Response filed Jan. 24, 2022 to Office Action dated Oct. 6, 2021", 14 pgs.
"Canadian Application Serial No. 3,090,607, Office Action dated Oct. 6, 2021", 5 pgs.
"Canadian Application Serial No. 3,090,607, Examiner's Rule 86(2) Report dated Sep. 21, 2022", 5 pgs.
"Canadian Application Serial No. 3,090,607, Response field Jan. 5, 2023 to Examiner's Rule 86(2) Report dated Sep. 21, 2022", 24 pgs.

* cited by examiner

*Primary Examiner* — Robert J McCarry, Jr.
(74) *Attorney, Agent, or Firm* — Schwegman Lundberg & Woessner, P.A.

(57) ABSTRACT

Systems and methods are disclosed including a system that can include a traffic gate, an electronic circuit and a portable controller. The traffic gate can have an arm. The electronic circuit can have a controller, a first communication module, and one or more light sources configured to mount to the arm or other portions of the traffic gate. The controller can be configured to control the electronic circuit to selectively operate the one or light sources as desired. The portable controller can have a second communication module configured to communicate with the first communication module to actuate the controller to control of the electronic circuit.

13 Claims, 5 Drawing Sheets

REMOTE CONTROL OF TRAFFIC GATES

PRIORITY APPLICATION

This application claims priority to U.S. Provisional Application Ser. No. 62/890,398, filed Aug. 22, 2019, the disclosure of which is incorporated herein in its entirety by reference.

TECHNICAL FIELD

The present subject matter relates, in general, to controlling traffic gates such as railway crossing gates, and in particular, to remote implemented control of such traffic gates including the signal lights of such traffic gates.

BACKGROUND

Traffic support personnel such as those from a state's Department of Transportation (DoT) utilize traffic gates to regulate traffic flow including flow of High Occupancy Vehicles (HOV). Railways also employ railway support personnel to maintain and regulate railway crossing guards and associated signal lights. Both DoT and railways expend considerable resources in operating, monitoring, and troubleshooting traffic gates. For example, currently, most railroad traffic gates are controlled through manipulation of control systems physically coupled to the crossing gates under such control.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION OF THE DRAWINGS

Figure 1:
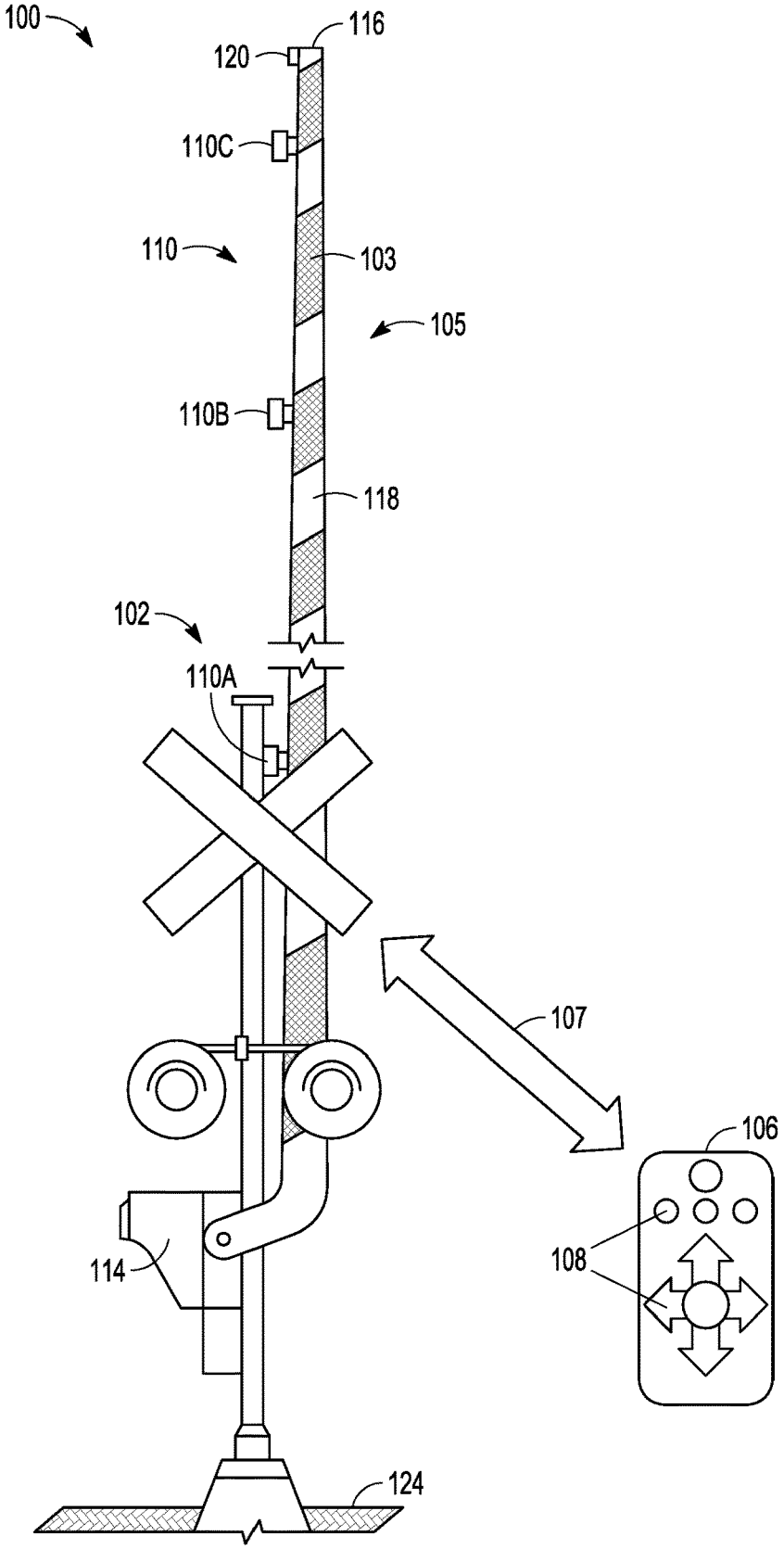
FIG. 1 is a schematic diagram of a system for controlling signal lights of a traffic gate according to one example embodiment.

The subject matter described herein relates to traffic gates such as railway crossing gates, and in particular, to signal lights of such gates and how these signal lights may be controlled, set or otherwise implemented wirelessly using a portable remote. Systems, methods and machine implemented solutions as described herein that may be implemented in a variety of computing environments, and are not limited to the specific embodiments described. For example, these systems and methods in other embodiments could be implemented on a mobile computing environment such as on a plurality of computing devices such as a server, a desktop personal computer, a notebook or a portable computer, smartphone, or a mainframe computer.

Railroad crossing gates are in widespread use and are provided with long crossing arms for traffic barriers. The crossing arms are normally upright and are swung to a lowered, substantially horizontal position when an approaching train is detected. The crossing arms of railroad crossing gates are provided with various signal lights that are secured to the crossing arm. Conventionally, three signal lights are used. A first light is disposed at the free end of the crossing arm. The remaining two lights are generally spaced along the crossing arm. It is conventional that the lights be incorporated into an electrical circuit such that the light at the free end is constantly illuminated when the crossing arm is in its horizontal position. The remaining signal lights are disposed in the electrical circuit such that they are flashing with the two lights alternately flashing off and on.

Conventionally, controls for railway crossing gates are within an enclosure in close proximity to the railway gate being controlled. This can be an enclosure physically coupled to a railway switch machine. For example, such controls are usually located close to each railway crossing gate, often in a standalone, weather-resistant electrical box. This arrangement requires railroad support personnel to manually access and manipulate the switch machine at each location to perform maintenance and operational tasks. When such machines are in need of service or operational update, there may be environmental hazards (e.g., snow and ice, close proximity to operating rail lines, etc.) which pose safety issues for workers.

It should be noted that although the present application discusses specifically railway crossing gates other traffic gates such as those for HOV, traffic diversion, vehicle parking, etc. are contemplated herein. Thus, the term "traffic gate" as used herein should not be construed to cover only railway crossing gates. Traffic support personnel such as those from a state's DoT will also benefit from the systems, methods and machines discussed herein as their exposure to potential environmental hazards will be reduced.

In view of the above, the present inventors propose systems, methods and machines by which personnel can perform various operational tasks (e.g., set operational characteristics of lighting, set and teach gate position for sensing purpose, switch the configuration/type of lighting circuitry used, etc.) remotely from the railway switch machine and gate location. This improves safety for personnel by reducing exposure to potential environmental hazards.

Figure 1A:
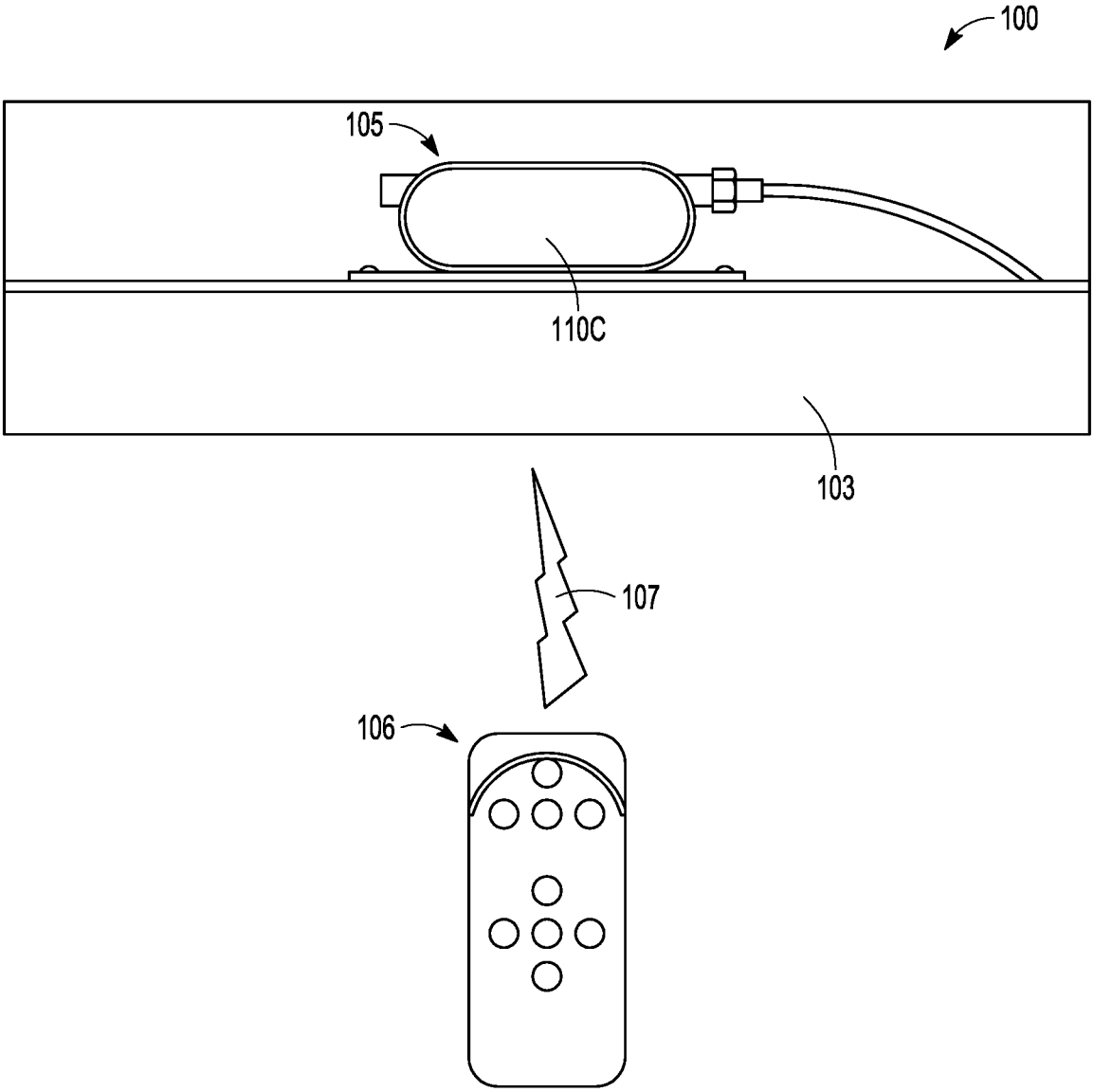
FIG. 1A is a schematic diagram of components of the system of FIG. 1.

FIG. 1 shows a system 100 according to an example embodiment. The system 100 includes a traffic gate 102 with an arm 103, an electronic circuit 105, a remote device 106 and a communication system 107. The remote device 106 can include inputs 108. FIG. 1A shows certain aspects of the system 100 including a portion of the arm 103 and the remote device 106.

The arm 103 is moveably coupled to the remainder of the traffic gate 102 and is moveable from a raised (substantially vertical) position to a lowered (substantially horizontal) position. FIG. 1 shows arm in the raised position. The electronic circuit 105 can be mounted to the traffic gate 102 including the arm 103 and can include one or more light sources 110 (discussed in detail subsequently), a controller, memory, communication module, sensor module, etc. as further discussed subsequently. The remote device 106 can communicate with the electronic circuit 105 wirelessly using the communication system 107. The remote device 106 can include the inputs 108 for the electronic circuit 105 that can change or set the operational characteristics of the system 100 including the one or more light sources 110 as discussed subsequently. Thus, the inputs 108 can be programmed to correspond with specific operation modes, values, etc.

The traffic gate 102 includes a base 114 that is coupled to the ground or another object close to a railway 124. The arm 103 can be moveable from the raised position (shown in FIG. 1) to the lowered position (shown in FIG. 1A) relative to the base 114. The base 114 can optionally house or otherwise carry aspects of the electrical circuit 105 discussed subsequently. However, in other embodiments the electronic circuit 105 can be entirely coupled to the arm 103 (e.g., can be attached to or in close proximity to the one or more light sources 110, etc.). Although a single electronic circuit 105 is described herein it should be recognized that multiple of such circuits (e.g., one for each of the one or more lights sources 110) can be utilized.

Regarding the arm 103, the arm 103 can include a first end portion 116 and a second end portion 118. The second end portion 118 can be coupled to the base 114. Thus, in the raised position of FIG. 1, the first end portion 116 can be positioned above the second end portion 118. In the lowered position, the first end portion 116 and the second end portion 118 can be at substantially a similar height above one or more of the railway 124, ground, horizontal, etc.

The traffic gate 102 includes the one or more light sources 110 (also called simply lights, lamps, diodes herein) mounted to the arm 103. FIG. 1 shows a typical railway crossing lighting scheme with three light sources on the arm 103 indicated as 110A, 110B and 110C as well as other one light sources coupled to the base 114 of the traffic gate 102. It should be appreciated that in an alternative embodiment, any suitable number of light sources 110 and mounted locations may be used.

According to the illustrated embodiment, the one or more light sources 110A, 110B and 110C are EZ Gate® LED Lamps with Light Out Detection (LOD). The light sources 110A, 110B and 110C are configured to provide light at the arm 103. It should be understood that although in the depicted embodiment the light sources 110A, 110B and 110C are EZ Gate® LED lamps with LOD, the light sources 110A, 110B and 110C could alternatively be any other type of light emitting diodes (LED) or a non-LED lamp such as an ordinary incandescent bulb. The electronic circuit 105 can be configured to operate a select number of the plurality of light emitting diodes based upon the switch machine utilized with the system 100.

As shown in the embodiment of FIG. 1, the system 100 can optionally include an arm position sensor 120 mounted to the arm 103. This sensor 120 can be mounted to the arm 103 in any location and is not limited to the location illustrated in FIG. 1. The sensor 120 is configured to electronically communicate with at least one of a controller of the electronic circuit 105 and a controller of the remote device 106. The sensor 120 can be configured to sense if the arm 103 is in the raised position or the lowered position. According to one example, the sensor 120 can utilize a 3-axis G-sensor (accelerometer) available from ST Micro. However, other types of sensors are contemplated.

As depicted in FIG. 1, the sensor 120 can be an EZ Gate® Arm Positioning Sensor, available from Railway Equipment Co., which is mounted to the first end portion 116 of the arm 103. The sensor 120 can be configured to connect to the electronic circuit 105 (here including a railroad crossing signal gate arm circuit with the one or more light sources 110), which introduces a known electrical load to the electronic circuit 105 based on position of the arm 103 relative to level grade or another reference. The purpose of the sensor 120 can be to provide feedback of the arm 103 position relative to level grade to determine if the gate has been damaged, is lowered or is faulty in its operation. This is achieved by simply connecting the device to the electronic circuit 105 such as via the last light 110C on the gate arm 103.

In one aspect of the present application, one of the inputs 108 of the remote device 106 can be used in conjunction with the electronic circuit 105 and the sensor 120 to program the sensor 120. In particular, one of the inputs 108 can be actuated to indicate the arm 103 is in the lowered position. This signal can be utilized to teach the sensor 120 it is in the lowered position for future sensing purposes, for example. Thus, the remote device 106 can be configured to communicate data with the position sensor 120 (this can be via the electronic circuit 105 or directly with the sensor 120). The data is indicative that the arm 103 is in the lowered position (or another position such as the raised position). The position sensor 120 can be configured to store the data for reference to sense if the arm 103 is in the lowered position (or in another position).

The communication system 107 between the electronic circuit 105 and the remote device 106 can be implemented using any known wireless modality such as, but not limited to, Bluetooth, WiFi, optical (e.g., IR), RF, etc. FIGS. 1 and 1A shows the remote device 106 within range and communicating with the electronic circuit 105. This can be by bringing the remote device 106 to within sufficient proximity of the traffic gate 102 and the one or more of the light sources 110.

Figure 2:
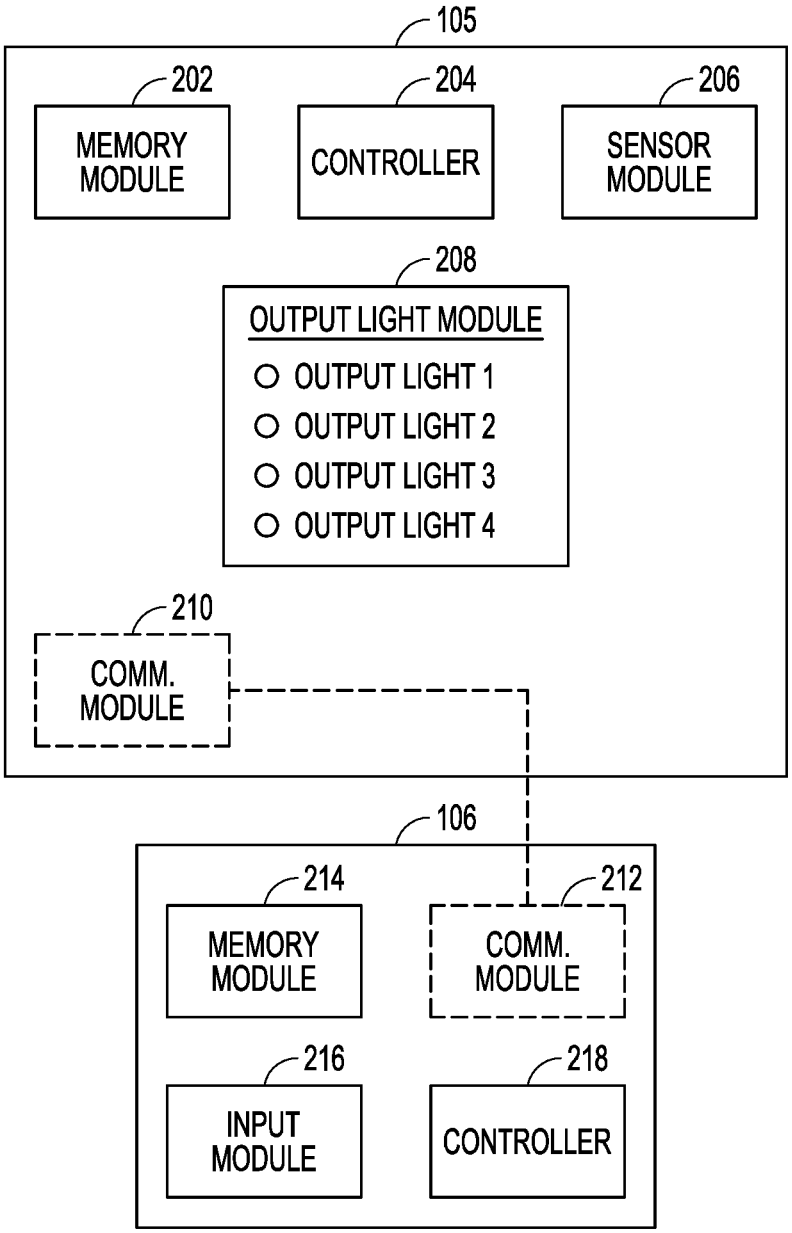
FIG. 2 illustrates hardware used to implement the system interface, according to one example embodiment.

FIG. 2 shows an example of hardware utilized by the system 100 according to an example embodiment. According to some examples, various of the hardware illustrated in FIG. 2 may not be utilized and instead aspects can be implemented by other hardware, software or other known methodology. FIG. 2 shows the electronic circuit 105 and the remote device 106 as previously illustrated in FIGS. 1 and 1A.

According to the embodiment of FIG. 2, the electronic circuit 105 can include a memory module 202, a controller 204, a sensor module 206, an output light module 208 and a communication module 210. The remote device 106 can include a communication module 212, a memory module 214, an input module 216 and a controller 218.

The controller 204 and the controller 218 can be embedded or integrated controllers that can be part of the system 100. The controllers 204, 218 (and indeed the electronic circuit 105) can comprise one or more processors, microprocessors, microcontrollers, electronic control modules (ECMs), system on chip (SOC) such as application specific integrated circuit (ASIC), electronic control units (ECUs), or any other suitable means for electronically controlling the system 100 including the signal lights operating characteristics, etc. The controllers 204, 218 can be can be configured to operate according to a predetermined algorithm or set of instructions for controlling the system 100 based on various predefined operating characteristics of the traffic gate 102 and the one or more light sources 110 (FIG. 1). These operating characteristics can be based on, for example, input from the sensor 120, input from inputs 108, etc. The operating characteristics can include, but are not limited to, at least one of a brightness of illumination for the one or more light sources, a frequency of illumination for the one or more light sources, when to commence illumination for the one or more light sources, when to de-commence illumination for the one or more light sources, a number of the one or more light sources to illuminate, a type of the one or more light sources to illuminate, a color of illumination for the one or more light sources, etc.

The algorithms or set of instructions utilized by one or more of the controllers 204, 218 can be stored in a database, can be read into on-board memory, or can be preprogrammed into memory module 202 and/or memory module 214. The memory module 202 and/or memory module 214 can be in the form of a hard drive, jump drive, optical medium, random access memory (RAM), read-only memory (ROM), removable memory card such as micro-SD, or any other suitable computer readable storage medium commonly used in the art.

The sensor module 206 can be in electrical communication or connected to the controller 204 and/or the controller 218 and can be in electrical communication or connected to the position sensor 120 (FIG. 1). The sensor module 206 can include instructions, etc. for interpreting data from or otherwise communicating with the position sensor 120. The output light module 208 interfaces and communicates with the one or more light sources 110. In some cases, the output light module 208 can indicate various data such as the mode setting, etc. analogous to the one or more light sources 110.

The communication modules 210 and 212 are configured to enable wireless communication from the remote device 105 to the electronic circuit 106. In some embodiments, communication can be between (back and forth) the remote device 105 and the electronic circuit 106. The communication modules 210 and 212 can be an optical module (e.g., IR module), an integrated RF module, a card-connected RF module, etc. An example of a card-connected RF module is an XBee RF Module available from Digi International® Inc. (Digi®) of Minnetonka, Minn., such as model number XB24-Z7PIT-004, which operates in a frequency band of 2.4 GHz, has a line of sight range of 120 meters, can communicate at a rate of 250 Kbps. According to one example, the communication module 210 comprises an optical receiver and the communication module 212 comprises an optical transmitter. According to another example, the communication module 210 comprises a radio frequency receiver and the communication module 212 comprises a radio frequency transmitter. The input module 218 can be configured to receive input from inputs 108 (FIG. 1) and can communicate such data to the controller 218.

Thus, according to one embodiment the system 100 can include a traffic gate including an arm; an electronic circuit having a controller, a first communication module, and one or more light sources configured to mount to the arm or other portions of the traffic gate, wherein the controller is configured to control the electronic circuit to selectively operate the one or light sources as desired; and a portable controller having a second communication module configured to communicate with the first communication module to actuate the controller to control of the electronic circuit.

Figure 3:
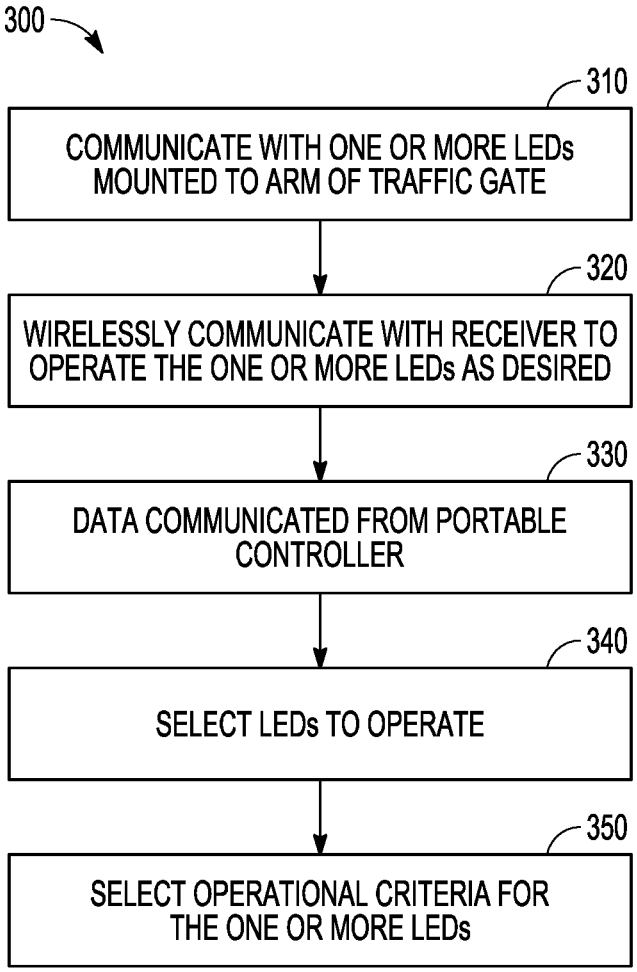
FIG. 3 illustrates a method for wireless control of signal lights of the traffic gate, according to one example embodiment.

FIG. 3 illustrates an example method 300. The operations of method 300 may be performed in whole or part by one or more components described above with respect to FIGS. 1-2. At operation 310, a receiver electronically communicating with one or more light emitting diodes mounted to a traffic gate is provided. Railroad support personnel may connect to the receiver to adjust, set or otherwise operate the one or more light emitting diodes. Thus, at operation 320, such connection can be used to wirelessly communicate with the receiver to operate the one or more light emitting diodes as desired. Optionally, at operation 330, data can be communicated via a portable controller hand-held by the personnel to a position sensor. The data can be indicative that the position sensor is in the lowered position with the gate arm. The position sensor can be configured to store the data for reference to sense if the arm is in the lowered position. Optionally, at operation 340, the portable controller can be used to select a number of the plurality of light emitting diodes to operate. Optionally, at operation 350, the method 300 communicates operating characteristics such as at least one of a brightness of illumination, a frequency of illumination (flash or pulse frequency/rate), when to commence illumination, when to de-commence illumination, a number of the one or more light sources to illuminate, a type of the one or more light sources to illuminate and a color of illumination.

Although embodiments have been described in language specific to structural features and/or methods, it is to be understood that the invention is not necessarily limited to the specific features or methods described. Rather, the specific features and methods are disclosed as exemplary implementations for wireless remote control of traffic gates, specifically, the lamps thereof.

Figure 4:
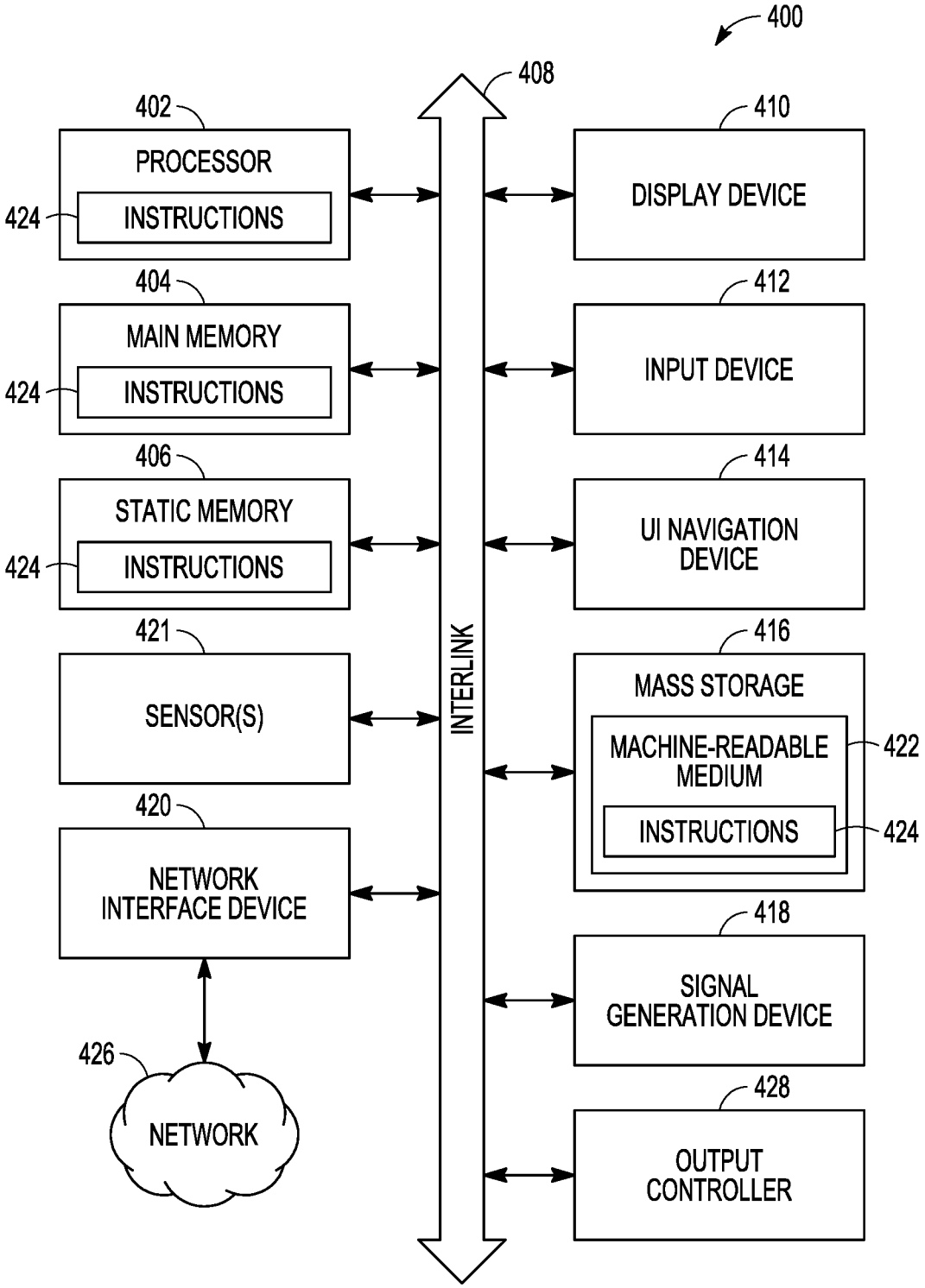
FIG. 4 is a block diagram illustrating an example of a machine upon which one or more embodiments may be implemented.

FIG. 4 illustrates a block diagram of an example machine 400 upon which any one or more of the, systems, methods or techniques (e.g., methodologies) discussed herein may perform. In alternative embodiments, the machine 400 may operate as a standalone device or may be connected (e.g., networked) to other machines. In a networked deployment, the machine 400 may operate in the capacity of a server machine, a client machine, or both in server-client network environments. In an example, the machine 400 may act as a peer machine in peer-to-peer (P2P) (or other distributed) network environment. The machine 400 may be a personal computer (PC), a tablet PC, a Personal Digital Assistant (PDA), a mobile telephone, smartphone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" or "controller" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 400 may include a hardware processor 402 (e.g., a central processing unit (CPU), a graphics processing unit (GPU), a hardware processor core, or any combination thereof), a main memory 404 and a static memory 406, some or all of which may communicate with each other via an interlink (e.g., bus) 408. The machine 400 may further include a display unit 410, an alphanumeric input device 412 (e.g., a keyboard), and a user interface (UI) navigation device 414 (e.g., a mouse). In an example, the display unit 410, input device 412 and UI navigation device 414 may be a touch screen display. The machine 400 may additionally include a storage device (e.g., drive unit) 416, a signal generation device 418 (e.g., a transmitter), a network interface device 720, and one or more sensors 721, etc. The machine 400 may include an output controller 728, such as a serial (e.g., universal serial bus (USB), parallel, or other wired or wireless (e.g., infrared (IR)) connection to communicate or control one or more devices (e.g., the one or more light sources 110 of FIGS. 1 and 1A).

The storage device 416 may include a machine readable medium 422 on which is stored one or more sets of data structures or instructions 424 (e.g., software) embodying or utilized by any one or more of the techniques or functions described herein. The instructions 424 may also reside, completely or at least partially, within the main memory 404, within static memory 406, or within the hardware processor 402 during execution thereof by the machine 400. In an example, one or any combination of the hardware processor 402, the main memory 404, the static memory 406, or the storage device 416 may constitute machine readable media.

While the machine readable medium 422 is illustrated as a single medium, the term "machine readable medium" may include a single medium or multiple media (e.g., a centralized or distributed database, and/or associated caches and servers) that arranged to store the one or more instructions 424.

The term "machine readable medium" may include any medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine readable medium examples may include solid-state memories and optical and magnetic media. In an example, a massed machine readable medium comprises a machine readable medium with a plurality of particles having resting mass. Specific examples of massed machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 424 may further be transmitted or received over a communications network 426 using a transmission medium via the network interface device 420 (i.e. a communication device) utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, wireless data networks (e.g., Institute of Electrical and Electronics Engineers (IEEE) 802.11 family of standards known as Wi-Fi®, and IEEE 802.16 family of standards known as WiMax®), and peer-to-peer (P2P) networks, Bluetooth, among others. In an example, the network interface device 420 may include one or more physical jacks (e.g., Ethernet, coaxial, or phone jacks) or one or more antennas to connect to the communications network 426. In an example, the network interface device 420 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 400, and includes digital or analog communications signals or other intangible medium to facilitate communication of such software.

ADDITIONAL NOTES & EXAMPLES

Example 1 is a system optionally comprising any one or combination of: a traffic gate including an arm; an electronic circuit having a controller, a first communication module, and one or more light sources configured to mount to the arm or other portions of the traffic gate, wherein the controller is configured to control the electronic circuit to selectively operate the one or light sources as desired; and a portable controller having a second communication module configured to communicate with the first communication module to actuate the controller to control of the electronic circuit.

Example 2 is the system of Example 1 or any other one or combination of the Examples herein, wherein the first communication module optionally comprises an optical receiver and the second communication module comprises an optical transmitter.

Example 3 is the system of Examples 1-2 or any other one or combination of the Examples herein, wherein the first communication module optionally comprises a radio frequency receiver and second communication module comprises a radio frequency transmitter.

Example 4 is the system of any one or combination of Examples 1-3 or any other one or combination of the Examples herein, further comprising a position sensor configured to mount to the arm and configured to electronically communicate with at least one of the controller and portable controller, wherein the position sensor is configured to sense if the arm is in a raised position with a first end portion of the arm positioned above a second end portion or a lowered position where the first end portion and the second end portion are at substantially a similar height.

Example 5 is the system of Example 4 or any other one or combination of the Examples herein, wherein the portable controller can optionally be configured to communicate data with the position sensor, wherein the data is indicative that the arm is in the lowered position, and wherein the position sensor is configured to store the data for reference to sense if the arm is in the lowered position.

Example 6 is the system of any one or combination of Examples 1-5 or any other one or combination of the Examples herein, wherein the one or more light sources optionally comprise a plurality of light emitting diodes, and wherein the electronic circuit is configured to operate a select number of the plurality of light emitting diodes.

Example 7 is the system of any one or combination of Examples 1-6 or any other one or combination of the Examples herein, wherein the portable controller is configured to select operating characteristics for the one or more lights sources to operate at, wherein the operating characteristics comprise at least one of a brightness of illumination, a frequency of illumination, when to commence illumination, when to de-commence illumination, a number of the one or more light sources to illuminate and a color of illumination.

Example 8 is a method optionally comprising any one or combination of: providing receiver electronically communicating with one or more light emitting diodes mounted to a traffic gate; and wirelessly communicating with the receiver to operate the one or more light emitting diodes as desired.

Example 9 is the method of Example 8 or any other one or combination of the Examples herein, wherein wirelessly communicating with the receiver optionally includes operating a portable controller electronically coupled to a transmitter to communicate with the receiver.

Example 10 is the method of Example 9 or any other one or combination of the Examples herein, optionally further comprising: mounting a position sensor to the arm to sense if the arm is in a raised position with a first end portion of the arm positioned above a second end portion or a lowered position where the first end portion and the second end portion are at substantially a similar height; and providing data via the portable controller to the position sensor, the data indicative that the position sensor is in the lowered position, and wherein the position sensor is configured to store the data for reference to sense if the arm is in the lowered position.

Example 11 is the method of any one or combination of Examples 9-10 or any other one or combination of the Examples herein, optionally further comprising selectively operating the portable controller to select a number of the plurality of light emitting diodes to operate.

Example 12 is the method of any one or combination of Examples 8-11 or any other one or combination of the Examples herein, wherein the receiver optionally comprises one of an optical receiver or a radio frequency receiver.

Example 13 is the method of any one or combination of Examples 8-12 or any other one or combination of the Examples herein, wherein wirelessly communicating with the receiver to operate the one or more light emitting diodes optionally includes communicating at least one of a brightness of illumination, a frequency of illumination, when to commence illumination, when to de-commence illumination, a number of the one or more light sources to illuminate and a color of illumination.

Example 14 is a computer-readable medium comprising instructions that, when executed by a machine, optionally cause the machine to: communicate wirelessly using a receiver with transmitter operably coupled with a portable controller, wherein the receiver is part of an electrical circuit including one or more light sources mounted to a traffic gate; and operate the one or more light sources using the portable controller.

Example 15 is the computer-readable medium of Example 14 or any other one or combination of the Examples herein, wherein the receiver optionally comprises one of an optical receiver or a radio frequency receiver.

Example 16 is the computer-readable medium of any one or combination of Examples 14-15 or any other one or combination of the Examples herein, wherein the instructions further optionally cause the machine to operate the one or more light sources with desired operating characteristics that comprise at least one of a brightness of illumination, a frequency of illumination, when to commence illumination, when to de-commence illumination, a number of the one or more light sources to illuminate and a color of illumination.

Example 17 is the computer-readable medium of any one or combination of Examples 14-16 or any other one or combination of the Examples herein, wherein the instructions further optionally cause the machine to communicate with a position sensor coupled to an arm of traffic gate, wherein the portable controller is configured to communicate data with the position sensor, wherein the data is indicative that the arm is in the lowered position, and wherein the position sensor is configured to store the data for reference to sense if the arm is in a lowered position.

Example 18 is the computer-readable medium of any one or combination of Examples 14-17, wherein the instructions further optionally cause the machine to via the portable controller select a number of the plurality of light emitting diodes to operate.

The above detailed description includes references to the accompanying drawings, which form a part of the detailed description. The drawings show, by way of illustration, specific embodiments in that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure, for example, to comply with 37 C.F.R. § 1.72(b) in the United States of America. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A system comprising:

a traffic gate including an arm;

an electronic circuit having a controller, a first communication module, and one or more light sources configured to mount to the arm or other portions of the traffic gate, wherein the controller is configured to control the electronic circuit to selectively operate the one or more light sources as desired;

a portable controller having a second communication module configured to communicate with the first communication module to actuate the controller to control of the electronic circuit; and a position sensor configured to mount to the arm and configured to electronically communicate with at least one of the controller and the portable controller, wherein the position sensor is configured to sense if the arm is in a raised position with a first end portion of the arm positioned above a second end portion or a lowered position where the first end portion and the second end portion are at substantially a similar height;

wherein the portable controller is configured to communicate data with the position sensor, wherein the data is indicative that the arm is in the lowered position, and wherein the position sensor is configured to store the data for reference to sense if the arm is in the lowered position.

2. The system of claim 1, wherein the first communication module comprises an optical receiver and the second communication module comprises an optical transmitter.

3. The system of claim 1, wherein the first communication module comprises a radio frequency receiver and second communication module comprises a radio frequency transmitter.

4. The system of claim 1, wherein the one or more light sources comprise a plurality of light emitting diodes, and wherein the electronic circuit is configured to operate a select number of the plurality of light emitting diodes.

5. The system of claim 1, wherein the portable controller is configured to select operating characteristics for the one or more light sources to operate at, wherein the operating characteristics comprise at least one of a brightness of illumination, a frequency of illumination, when to commence illumination, when to de-commence illumination, a number of the one or more light sources to illuminate and a color of illumination.

6. A method comprising:

providing receiver electronically communicating with one or more light emitting diodes mounted to a traffic gate;

wirelessly communicating with the receiver to operate the one or more light emitting diodes as desired, wherein wirelessly communicating with the receiver included operating a portable controller electronically coupled to a transmitter to communicate with the receiver;

mounting a position sensor to an arm of the traffic gate to sense if the arm is in a raised position with a first end portion of the arm positioned above a second end portion or a lowered position where the first end portion and the second end portion are at substantially a similar height; and providing data via the portable controller to the position sensor, the data indicative that the position sensor is in the lowered position, and wherein the position sensor is configured to store the data for reference to sense if the arm is in the lowered position.

7. The method of claim 6, further comprising selectively operating the portable controller to select a number of the one or more plurality of light emitting diodes to operate.

8. The method of claim 6, wherein the receiver comprises one of an optical receiver or a radio frequency receiver.

9. The method of claim 6, wherein wirelessly communicating with the receiver to operate the one or more light emitting diodes includes communicating at least one of a brightness of illumination, a frequency of illumination, when to commence illumination, when to de-commence illumination, a number of the one or more light emitting diodes to illuminate and a color of illumination.

10. A computer-readable medium comprising instructions that, when executed by a machine, cause the machine to:

communicate wirelessly using a receiver with transmitter operably coupled with a portable controller, wherein the receiver is part of an electrical circuit including one or more light sources mounted to a traffic gate;

operate the one or more light sources using the portable controller; and communicate with a position sensor coupled to an arm of traffic gate, wherein the portable controller is configured to communicate data with the position sensor, wherein the data is indicative that the arm is in a lowered position, and wherein the position sensor is configured to store the data for reference to sense if the arm is in the lowered position.

11. The computer-readable medium of claim 10, wherein the receiver comprises one of an optical receiver or a radio frequency receiver.

12. The computer-readable medium of claim 10, wherein the instructions further cause the machine to operate the one or more light sources with desired operating characteristics that comprise at least one of a brightness of illumination, a frequency of illumination, when to commence illumination, when to de-commence illumination, a number of the one or more light sources to illuminate and a color of illumination.

13. The computer-readable medium of claim 10, wherein the instructions further cause the machine to via the portable controller select a number of the one or more of light sources to operate.

* * * * *